United States Patent [19]

Hoogasian

[11] 4,071,237

[45] Jan. 31, 1978

[54] APPARATUS FOR EXERCISING MANUAL COORDINATION

[76] Inventor: Harold B. Hoogasian, 318 - 26th Ave., San Francisco, Calif. 94121

[21] Appl. No.: 669,342

[22] Filed: Mar. 22, 1976

[51] Int. Cl.[2] ..... A63F 9/00

[52] U.S. Cl. ..... 273/1 R; 46/51; 272/67; 273/58 K

[58] Field of Search ..... 273/1 R, 58 K, 97 R; 272/67; 46/47, 51

[56] References Cited

U.S. PATENT DOCUMENTS

| | | | |
|---|---|---|---|
| 820,017 | 5/1906 | Russell | 273/97 R |
| 1,858,145 | 5/1932 | Felardo | 46/51 |
| 3,015,908 | 1/1962 | Colletti | 273/1 R UX |
| 3,032,345 | 5/1962 | Lemelson | 273/1 R X |

FOREIGN PATENT DOCUMENTS

| | | | |
|---|---|---|---|
| 1,265,382 | 3/1972 | United Kingdom | 273/1 R |

*Primary Examiner*—William H. Grieb
*Attorney, Agent, or Firm*—Owen, Wickersham & Erickson

[57] ABSTRACT

Apparatus for exercising manual coordination. A ball with hooked members extending out from the ball along each of three mutually perpendicular axes, is used with a pair of ball manipulating devices, one held in each hand at right angles to each other. Each device has a flexible member rotatably secured to one end of a handle, for rotation in a plane at a right angle to the axis of the handle. The flexible member has an opening distant from the handle which can be used to catch one hook of the ball and whirl it around. The operator simultaneously rotates the flexible member of the other device with his other hand in a second plane normal to the first plane and seeks to engage a hooked portion with it and transfer the ball from one flexible member to the other and then back again, and so on.

5 Claims, 4 Drawing Figures

APPARATUS FOR EXERCISING MANUAL COORDINATION

BACKGROUND OF THE INVENTION

This invention relates to apparatus for exercising manual coordination. It may be used either as a toy or as a therapeutic device or as a device for generally improving coordination.

While there are various ways of exercising and improving manual coordination, the present device has the advantage of being interesting to operate, so that it can become practically a toy in the hands of a well-coordinated child or adult, while at the same time, it does require concentration and careful manipulation so that it aids in improvement of coordination. It can thus be used to interest people whose coordination especially needs improvement or in helping those who are, perhaps, bed-ridden for some other cause and need something to restore their confidence in their ability to do things or to keep the time going when they are unable to do some other things that they would like to do.

Thus, among the objects of the present invention are those of providing a system which aids in exercising and improving manual coordination and which is sufficiently interesting so that it can be used either as a therapeutic device or as a toy or as an entertainment in general.

SUMMARY OF THE INVENTION

The invention comprises a special ball and two-ball manipulating devices, all used in combination.

The ball preferably has six hooked members that extend out radially from the ball along each of three mutually perpendicular axes. Each member has a hooked portion making a slightly acute but nearly right angle with its radial portion.

The two ball-manipulating devices are identical. One is to be held in each hand, with them at right angles to each other. Each device has a handle and a flexible member rotatably secured to the handle and extending at a right angle to the axis of the handle. The flexible member has an opening distant from the handle and larger in width and in length than the hooked portions of the ball extensions.

An operator engages a hooked portion with one flexible member at an edge of its opening and rotates that flexible member in a first plane by moving the handle. He then rotates the flexible member of the other device with the other hand in a second plane normal to said first plane and seeks to engage some other hooked portion of the ball and thereby to transfer the ball from one flexible member to the other and then back again, and so on.

Other objects and advantages of the invention and other structural features will appear in the course of the following description.

DESCRIPTION OF A PREFERRED EMBODIMENT

Figure 2:
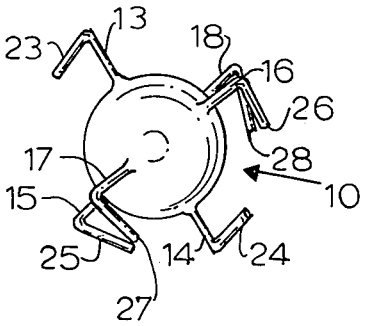
FIG. 2 is a view in perspective of a ball embodying the principles of the invention.
Figure 3:
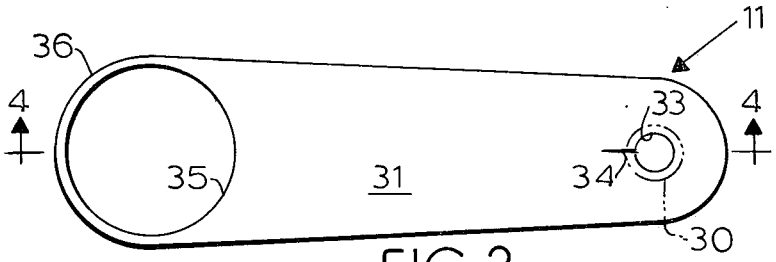
FIG. 3 is a top plan view of one of the two-ball manipulating tools.
Figure 1:
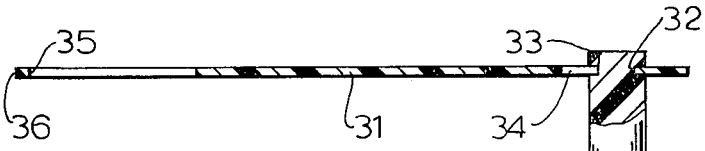
FIG. 1 is a view in perspective showing in use apparatus embodying the principles of the invention.
Figure 1:
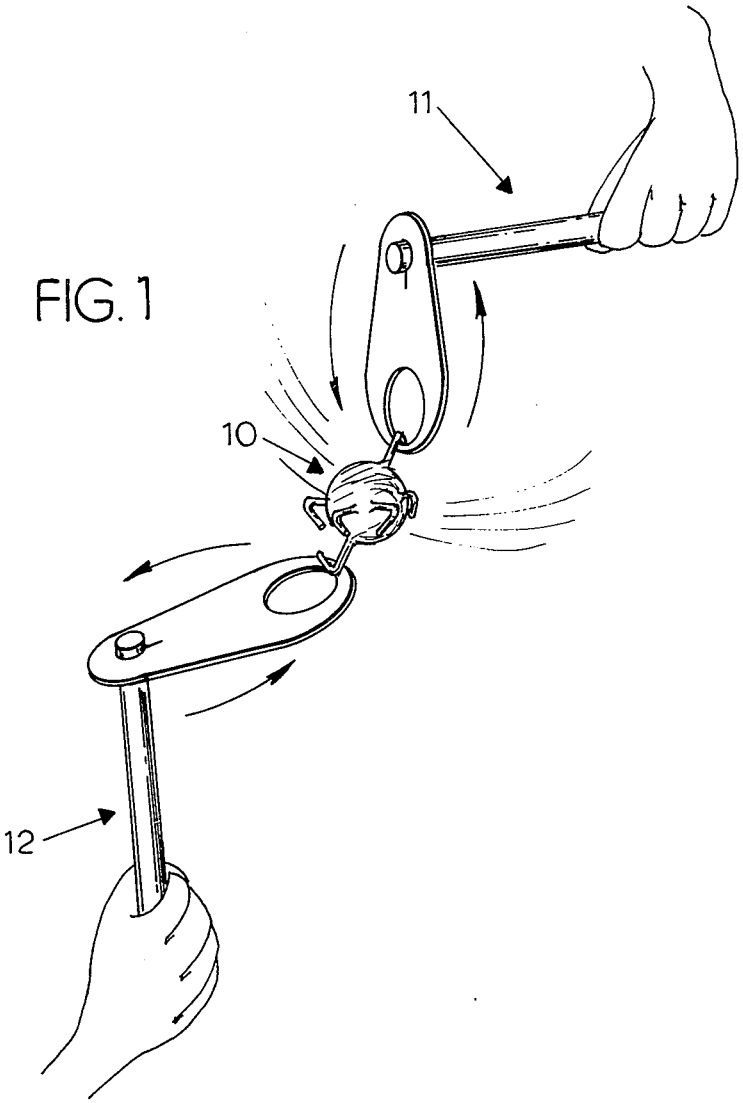
Figure 4:
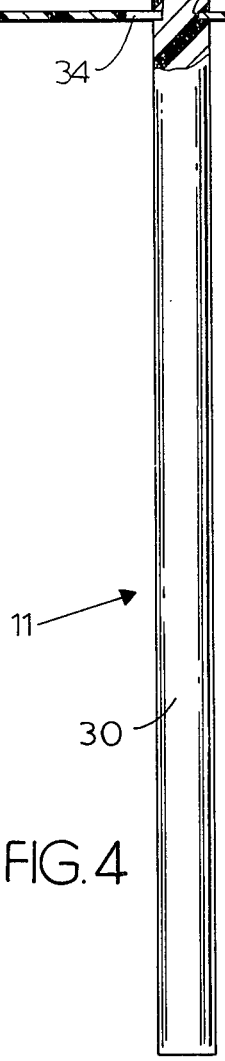
FIG. 4 is a view in section taken along the line 4—4 in FIG. 3.

As already stated, the device comprises a ball 10 and two-ball manipulating devices 11 and 12. FIG. 2 shows a ball 10 embodying the principles of the invention. The ball 10 itself is preferably round, but it need not be absolutely spherical. Along three axes, the typical X, Y, and Z axes, are provided projections 13, 14, 15, 16, 17, and 18, which may be integral parts of the ball 10, which may be made from a plastic having suitable stiffness. It is, therefore, desirable to have the entire ball 10 and its projections 13, 14, 15, 16, 17, and 18 made of materials which are not harmful even when flying rapidly through the air, if they should come up against a person or some object. Each projection 13, 14, 15, 16, 17, and 18 is hooked, having an end portion 23, 24, 25, 26, 27, and 28 turned in slightly more than 90° so that it forms an acute angle, though nearly a right angle. Preferably, the hooked portions along one diameter, e.g., the portions 23 and 24, are directed in opposite directions from each other, while the others are inclined in the same directions.

Each ball manipulating device 11 or 12 comprises a handle 30, which may be of relatively rigid plastic, a rotatable member 31 at one end. This rotatable member 31 may be made from flexible plastic. Thus, one can hold the handle 30 and whirl the member 31 around and around in its plane. The means for securing the two together may comprise an annular recess 32 in the handle 30 together with a small opening 33 through the member 31. The member 31 may have a slit provided to one side of the opening 33 to aid in installation. Other such devices, such as pins extending through a small opening and stuck into the handle, may be used if desired.

At a distal end of the flexible member 31 is a larger opening 35, preferably round though not necessarily so, and preferably having a size larger than the length of a hook portion 23 or 24, etc., of the ball 10. A terminal portion 36 at the distal end of the member 31, which surrounds about half of the opening 35 is preferably relatively narrow and quite flexible.

In operation, the operator places the ball 10 so that one member 13 or 14, etc., is in the opening 35 of one flexible member 31 and then by whirling the member 31 around, the ball 10 is retained by that member 31, the portion 36 engaging the hook portion 23 or 24, etc. Then he keeps the member 31 rotating with the ball 10 going around with it while beginning to rotate the flexible member 31 of the other device 12 at about a right angle to the first member 31. When he has the rotation going about right, he then seeks to snatch away the ball 10 from the other device 11 by engaging one of the hook portions 25 or 26, etc., with the second device 12 at the same time that it is rotating that device. After having once snatched it away, which takes a good deal of practice and coordination, he then can try to snatch it back with the original device 11. He may move the member 31 around so that they lie in slightly different planes and try it from different angles.

It usually takes quite awhile to make the first successful snatch, and it requires considerable practice before one can make it with regularity. However, all this time one is improving his manual coordination and all the mental things that go with true coordination. It is challenging and therefore is of interest, and yet it is capable of being done, once one has devoted himself to it for awhile so that it intrigues the operator into wanting to become proficient in its operation.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. Apparatus for exercising manual coordination including in combination:

a ball having projections along each of three mutually perpendicular axes on each side of said ball, each projection extending out radially from said ball and then having a hooked portion making a slightly acute nearly right angle with the radial portion, and a pair of ball manipulating devices, one to be held in each hand at right angles to each other, each said device comprising a handle, and a flexible member rotatably secured adjacent one end to one end of said handle and extending at a right angle to the axis of said handle, said flexible member including an opening distant from said one end, said opening being larger in width and in length than the hooked portions of said projections, whereby an operator engages a hooked portion with a said flexible member at an edge of said opening while rotating with one hand said flexible member of one said device in a first plane, and rotates the flexible member of the other said device with the other hand in a second plane normal to said first plane and seeks to engage a hooked portion and transfer it from one flexible member to the other and then back again, and so on.

2. The apparatus of claim 1 wherein said projections are integral with said ball.

3. Apparatus for exercising manual coordination including in combination:

a ball having a single isolated projection along a plurality of axes on each side of said ball, each projection extending out generally radially from said ball and then having a hooked-in portion, and a pair of ball manipulating devices, one to be held in each hand at right angles to each other, each said device comprising a handle, and a flexible member rotatably secured adjacent one end to one end of said handle and extending at a right angle to the axis of said handle, said flexible member comprising a flexible sheet including an opening distant from said one end, said opening being larger in width and in length than the hooked-in portions of said projections, the thickness of said flexible member being less than the length of said hooked-in portions.

4. The apparatus of claim 3 wherein said projections are integral with said ball.

5. A ball manipulating device for use with a ball having projections along each of three mutually perpendicular axes on each side of said ball, each projection extending out radially from said ball and then having a hooked portion making a slightly acute nearly right angle with the radial portion, said device comprising a handle, and a flexible member rotatably secured adjacent one end to one end of said handle and extending at a right angle to the axis of said handle, said flexible member comprising a flexible sheet including an opening distant from said one end, said opening being larger in width and in length than the hooked portions of said projections, said flexible member being thinner than the length of said hooked portion.

* * * * *